US005938406A

United States Patent [19]

Cerruti

[11] Patent Number: 5,938,406

[45] Date of Patent: Aug. 17, 1999

[54] ROTOR FOR TURBOMOLECULAR PUMP

[75] Inventor: Roberto Cerruti, Turin, Italy

[73] Assignee: Varian, Inc., Palo Alto, Calif.

[21] Appl. No.: 09/231,186

[22] Filed: Jan. 13, 1999

Related U.S. Application Data

[62] Division of application No. 08/844,505, Apr. 18, 1997.

[51] Int. Cl.[6] ..... F04D 29/38

[52] U.S. Cl. ..... 416/241 R; 415/90

[58] Field of Search ..... 416/241 R, 224; 415/90, 200, 217.1

[56] References Cited

U.S. PATENT DOCUMENTS

| | | | |
|---|---|---|---|
| 4,826,394 | 5/1989 | Lotz | 415/90 |
| 4,832,993 | 5/1989 | Coulon | 416/224 |
| 5,154,978 | 10/1992 | Nakayama et al. | 428/469 |
| 5,350,275 | 9/1994 | Ishimaru | 415/90 |
| 5,395,221 | 3/1995 | Tucker, Jr. et al. | 418/48 |
| 5,449,273 | 9/1995 | Hertel et al. | 416/224 |
| 5,547,338 | 8/1996 | Conrad et al. | 415/90 |

*Primary Examiner*—John Kwon
*Attorney, Agent, or Firm*—BellaFishman

[57] ABSTRACT

The present invention relates to a rotor of a vacuum pump comprising a rotatable shaft and a plurality of spaced apart parallel rotor disks secured to said rotatable shaft, such rotor being provided with a corrosion-resistant protective coating formed by a layer of polymeric material. The protective coating of the present invention may apply to any of the stationary or rotational parts which are disposed within a pump body and may be exposed to corrosive gases.

6 Claims, 1 Drawing Sheet

ROTOR FOR TURBOMOLECULAR PUMP

This present application is a divisional of the U.S. application Ser. No. 08/844,505, filed Apr. 18, 1997.

FIELD OF THE INVENTION

The present invention relates to rotors of a vacuum pump, and more specifically refers to a rotor for those vacuum pumps known as turbomolecular pumps that are to be employed in the presence of particularly corrosive gases.

BACKGROUND OF THE INVENTION

As it is well known, a turbomolecular pump can schematically be regarded as comprising an outer casing in which a plurality of gas pumping stages are housed.

The gas pumping stages are generally obtained through an assembly of stator rings cooperating with rotor disks that are secured to a rotatable shaft driven by a pump motor.

The pumping stages comprise a space for allowing the gas flow, known at the pumping channel, where the surfaces of the rotor disk and the facing stator are relatively spaced away, and tight zones where the surfaces of the rotor disk and the facing stator are very near to each other.

The rotor disks can be either flat (plane) disks or disks that are provided with closely spaced apart inclined blades.

A vacuum pump of the turbomolecular type comprises both flat disks and bladed disks, and is capable of achieving pressure levels as low as $10^{-8}$ Pa.

In order to reach the above vacuum levels with the presently used pumps, the rotor must rotate at a speed as high as 100,000 rpm.

The vacuum pumps such as turbomolecular pumps is used in the field of Integrated Circuits (ICs) manufacturing. In the manufacturing cycle of ICs there are used gas mixtures such as HCl, Hbr, $Cl_2$, $Fl_2$, $NH_3$, etc. that are well-known as highly corrosive gases.

One of the main problems when using turbomolecular pumps in the ICs manufacturing industry, is due to the accumulation of a certain amount of gas because of the flow through the pumping stages.

As a consequence, the surfaces of the internal components of the pump, particularly the rotor surface, come into direct contact with such gas mixtures and are subjected to the corrosive action thereof.

There are also known rotors for turbomolecular pumps provided with a metal or ceramic coating as a protection against the action of such corrosive gases.

The known protective metal coating is generally applied to the rotor by means of nickel-plating, zinc plating or anodizing processes.

As already mentioned, the rotor of a turbomolecular pump is rotated at very high speeds, usually not lower than 25,000 rpm. Due to the very high rotation speed of the rotor and to the extremely reduced gap between the pump rotor and the stator in the pumping stages, a mass distribution in the rotor body that is not homogeneous with respect to its axis of rotation can cause a force unbalance which jeopardizes the working of the pump up to a failure of its components.

Thus, an essential requirement in manufacturing a turbomolecular pump, particularly to be used with corrosive gases, is to achieve a substantially perfect rotational balance of the rotor body.

The known metal or ceramic coatings used until now have the drawback of being unsuitable for application onto objects that are to remain perfectly balanced while maintaining very smooth surfaces such as the rotor of a turbomolecular pump. Due to the complex geometrical shape and the small size of the areas in which the blades are attached to the rotor, the thickness of the metal or ceramic coating may be sufficient and easily corroded.

In order to prevent this from happening, the amount of the protective material deposited onto the rotor body it is often increased, but this countermeasure can lead to a non-uniform thickness of the protection coating of the flat surfaces of the rotor disks that sometimes results in being too thick.

Consequently, an additional finishing step becomes necessary in order to level the surfaces on which the deposited material has a not uniform thickness.

The object of the present invention is to overcome the above-mentioned drawbacks by providing a rotor for a vacuum pump which is corrosion resistant while at the same time constructed easily and inexpensively.

SUMMARY OF THE INVENTION

In accordance with the present invention, there is provided a turbomolecular vacuum pump with stationary and rotational parts which are disposed within a pump body, and at least partially coated with a uniform corrosion-resistant protective coating formed by a layer of polymeric material having a straight-chain organic compound with molecular weight characteristic higher than 10,000. According to the preferred embodiment, an entire surface of rotor having a rotatable shaft with a plurality of spaced apart parallel rotor disks being secured to the shaft is coated with a polymeric material. The coating is provided by a polymerization of a reactive monomer onto the rotor's surface under vacuum. The preferable polymeric material for a layer formed by coating is poly-(p-xylylene). The thickness of the protective layer ranges between about 10 and 22 $\mu$m.

Further characteristics and advantages of the present invention will become evident from the description of some preferred but not exclusive embodiments thereof that are illustrated only by way of example in the attached drawings.

DESCRIPTION OF PREFERRED EMBODIMENTS

Figure 1:
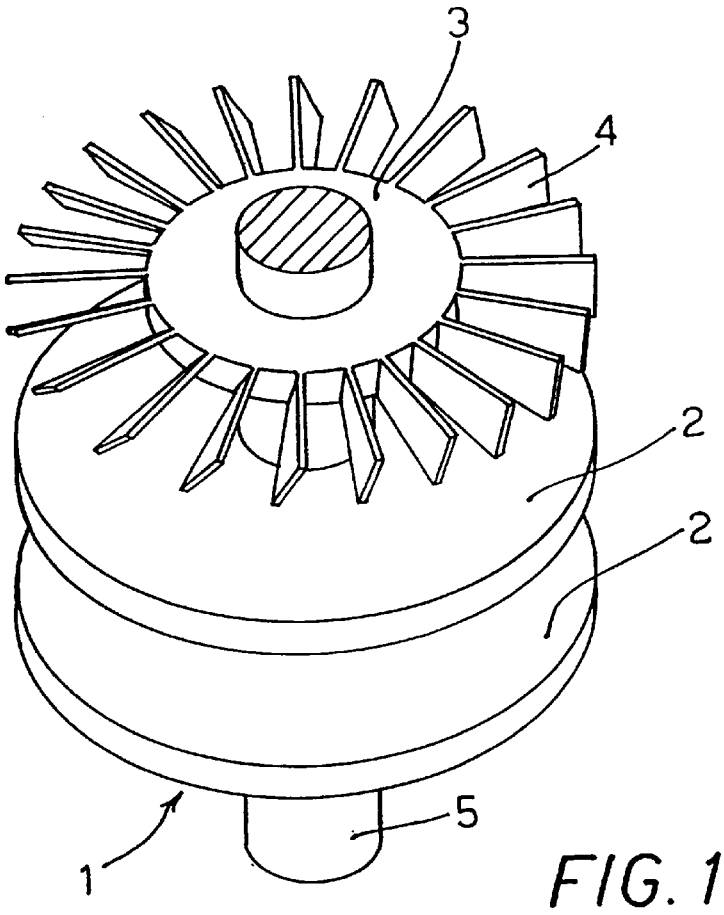
FIG. 1 is a perspective partial view of a rotor of a turbomolecular pump.

With reference to FIG. 1, a rotor 1 of a turbomolecular pump comprises a plurality of flat rotor disks 2 and a plurality of rotor disks 3 provided with projecting inclined blades 4.

Rotor disks 2 and 3 are secured to rotatable shaft 5 driven into rotation by a pump motor (not shown).

Figure 2:
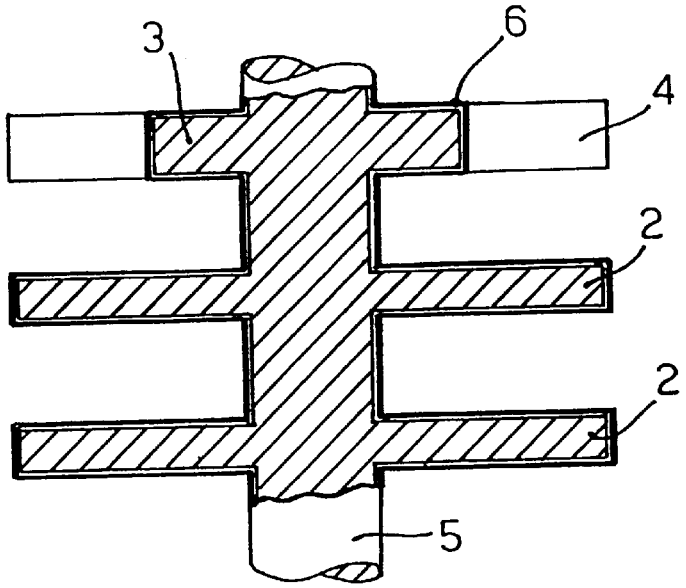
FIG. 2 is an enlarged cross-section view of the rotor's elements according to the present invention.

Referring also to the enlarged-cross section view of FIG. 2, the surface of the rotor according to the present invention is covered with a polymeric protective layer or film 6 that is uniformly distributed over the entire rotor surface. The polymer is preferably a straight-chain organic compound having a molecular weight higher than 10,000 and is electrically insulating.

In the embodiment shown in FIG. 2, the thickness of the protective layer 6 is shown to be substantially larger than the original size for a better appreciation.

The coating layer 6 is preferably obtained by polymerization of a reactive monomer over the rotor surface under vacuum conditions.

In a preferred embodiment of the invention the thickness of the protective layer 6 is comprised between 12 and 20 $\mu$m, with a tolerance of about ±2 $\mu$m, so that the thickness ranges between about 10 and 22 $\mu$m.

A preferred polymeric material for the layer 6 is a, so-called, poly-(p-xylylene), which is a polymer of (p-xylylene). In this case, the coating process comprises a vaporization of a dimmer of (p-xylylene) under vacuum, preferably under a pressure of 100 Pa at a temperature of about 150° C. Then the vapor is passed through a pyrolysis zone at a temperature of about 680° C. and a pressure of 50 Pa thus forming the monomer of (p-xylylene).

The monomer is then admitted into a coating chamber under a lower pressure, containing the rotor body that is continually rotating for a better distribution of the coating. The rotor is substantially at room temperature, i.e. is "cold", in respect of the monomer and this temperature difference causes a condensation with substantially simultaneous polymerization of the reactive monomer onto the rotor surface.

A suitable dimmer of (p-xylylene) is available from Ausimont under the trade name GALAXYL, or from Union Carbide under the trade name PARYLENE.

From laboratory comparative tests carried out by the Applicant, it has been discovered that the resistance to corrosion of a rotor treated according to the invention is much higher than that of rotors protected by conventional ceramic or metal layers.

It is deemed that the superior resistance to corrosion of the rotor according to the invention derives from both the corrosion resistant properties of the polymer coating, together with the high uniformity of the deposited layer which extends also over sharp edges or recessed areas, particularly at the junction of the rotor blades.

It is evident that the polymeric coating according to the invention can be also applied to other (stationary) components of a turbomolecular pump that are exposed to corrosion, such as the stator rings, the spacing rings located between the stators, the pump body and its inner surface.

What is claimed is:

1. A rotor for a vacuum pump having rotatable shaft and a plurality of rotor disks, parallel and spaced apart therebetween and secured to said rotatable shaft, said rotor comprising a corrosion resistant protective coating formed by a polymeric material layer of a uniform thickness less than 22 $\mu$m.

2. A rotor of claim 1, wherein said layer has a thickness in a range between about 10 and 22 $\mu$m.

3. The rotor of claim 1, wherein said polymeric material is a straight-chain organic compound having a molecular weight higher than 10,000.

4. The rotor of claim 1, wherein said protective coating is provided by a polymerization of a reactive monomer onto a rotor surface under vacuum.

5. The rotor of claim 1, wherein said protective coating is resistant to the corrosion by gases such as HCl, HBr, $Cl_2$, $Fl_2$, $NH_3$, and mixtures thereof.

6. The rotor of claim 2, wherein said polymeric material is poly-(p-xylylene).

* * * * *